US006585084B2

(12) United States Patent
Gannon

(10) Patent No.: US 6,585,084 B2
(45) Date of Patent: Jul. 1, 2003

(54) LADDER ASSIST WHEEL

(76) Inventor: Donald C. Gannon, 1267 Apple Trails Ct., Fenton, MO (US) 63026

( * ) Notice: Subject to any disclaimer, the term of this patent is extended or adjusted under 35 U.S.C. 154(b) by 0 days.

(21) Appl. No.: 09/951,647

(22) Filed: Sep. 12, 2001

(65) Prior Publication Data

US 2003/0047383 A1 Mar. 13, 2003

(51) Int. Cl.[7] ..... E06C 5/00; E06C 5/32
(52) U.S. Cl. ..... 182/129; 182/127
(58) Field of Search ..... 182/129, 22, 127, 182/165, 13–17, 20, 39, 107, 214, 206, 108, 109, 172, 230; 248/210, 238; 280/30, 47.17, 47.18, 47.24, 47.29, 645; 16/29

(56) References Cited

U.S. PATENT DOCUMENTS

| | | | | | |
|---|---|---|---|---|---|
| 2,559,856 | A | * | 7/1951 | Edhlund | 182/15 |
| 2,834,526 | A | * | 5/1958 | Paris | 182/16 |
| 3,396,815 | A | * | 8/1968 | Gleockler | 182/17 |
| 3,566,990 | A | * | 3/1971 | Fredricks et al. | 182/17 |
| 3,773,143 | A | * | 11/1973 | Del Prete et al. | 182/214 |
| 3,954,155 | A | * | 5/1976 | Guidara | 182/20 |
| 4,258,826 | A | * | 3/1981 | Murray | 182/20 |
| 4,311,207 | A | * | 1/1982 | Lurry | 182/107 X |
| 4,397,375 | A | * | 8/1983 | Hart | 182/206 |
| 4,448,282 | A | * | 5/1984 | Giezendanner | 182/16 X |
| 4,580,660 | A | * | 4/1986 | Oling | 182/107 |
| 4,754,843 | A | * | 7/1988 | Anderson | 182/129 |
| 4,911,263 | A | * | 3/1990 | Kuperman | 182/13 |
| 4,938,312 | A | * | 7/1990 | Trail | 182/206 |
| 5,082,086 | A | | 1/1992 | Kerr | |
| 5,282,520 | A | | 2/1994 | Walker | |
| 5,566,780 | A | | 10/1996 | Bambrough | |
| 5,584,357 | A | * | 12/1996 | Gugel et al. | 248/238 |
| 5,653,306 | A | * | 8/1997 | Bendickson et al. | 182/15 |
| 5,833,028 | A | | 11/1998 | Ramsey et al. | |
| 6,026,931 | A | * | 2/2000 | Swiderski | 182/15 |
| 6,276,490 | B1 | * | 8/2001 | Swanick, Jr. | 182/107 |
| 6,328,330 | B1 | * | 12/2001 | Haaser | 280/30 |

FOREIGN PATENT DOCUMENTS

| | | | | |
|---|---|---|---|---|
| GB | 2155528 | * | 9/1985 | 182/107 |

* cited by examiner

*Primary Examiner*—Daniel P. Stodola
*Assistant Examiner*—Hugh B. Thompson
(74) *Attorney, Agent, or Firm*—Sturm & Fix LLP

(57) ABSTRACT

A ladder assist wheel attached to the outer face of one of the ladder side rails. The wheel extends out from the outer face and rotates on an axis that is parallel to the plane of the outer face. A reinforcing plate is placed in contact with the inner face of the side rail and is operably attached to the wheel. The wheel is preferably positioned adjacent the bottom end of the side rail so that the ladder may be transported on its side by grasping the top end with one hand and allowing the wheel to contact and roll along the ground. For dual access folding stepladders, a wheel is attached to each of the side rails on one side of the ladder.

12 Claims, 1 Drawing Sheet

LADDER ASSIST WHEEL

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of accessories for ladders, and more particularly to a ladder assist wheel.

2. Description of Related Art

As can be seen by reference to the following U.S. Pat. Nos. 5,082,086; 5,282,520; 5,566,780; and 5,833,028, the prior art is replete with myriad and diverse wheel accessories for ladders.

While all of the aforementioned prior art constructions are more than adequate for the basic purpose and function for which they have been specifically designed, they are uniformly deficient with respect to their failure to provide a simple, efficient, and practical ladder assist wheel useful to facilitate the transport of ladders, particularly dual access ladders, from one location on a job site to another.

As a consequence of the foregoing situation, there has existed a longstanding need for a new and improved ladder assist wheel and the provision of such a construction is a stated objective of the present invention.

BRIEF SUMMARY OF THE INVENTION

Briefly stated, the present invention provides a ladder assist wheel attached to the outer face of one of the ladder side rails. The wheel extends out from the outer face and rotates on an axis that is parallel to the plane of the outer face. A reinforcing plate is placed in contact with the inner face of the side rail and is operably attached to the wheel. The wheel is preferably positioned adjacent the bottom end of the side rail so that the ladder may be transported on its side by grasping the top end with one hand and allowing the wheel to contact and roll along the ground. For dual access folding stepladders, a wheel is attached to each of the side rails on one side of the ladder.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
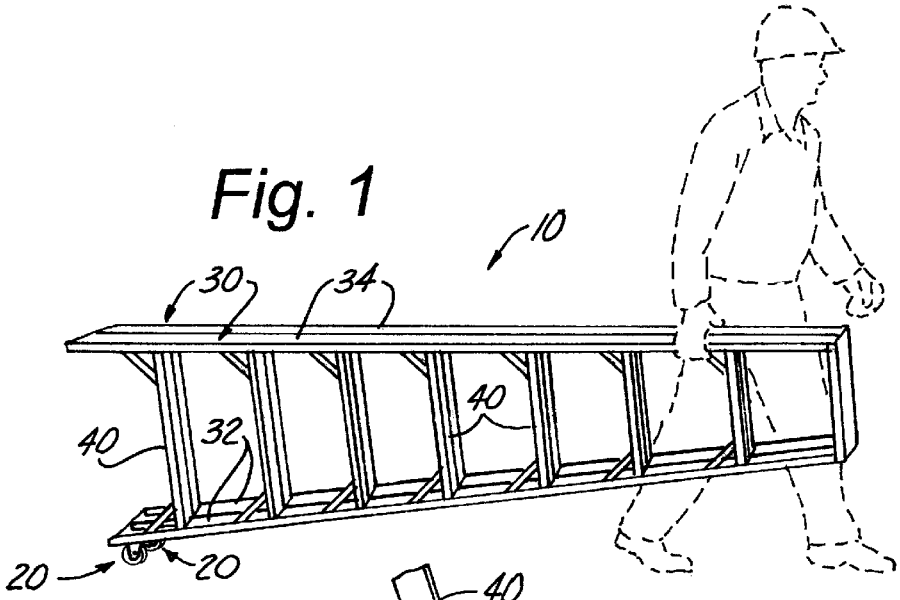
FIG. 1 is a perspective view illustrating ladder assist wheels attached to a dual access stepladder.
Figure 2:
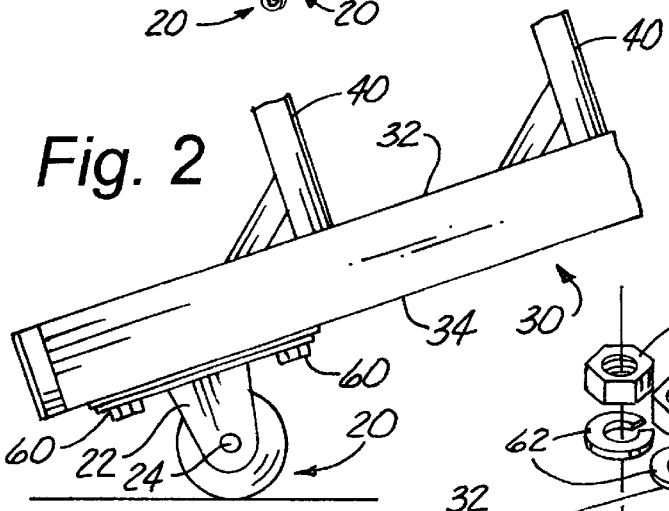
FIG. 2 is an enlarged partial side elevational view showing the ground engaging wheel.

As can be seen by reference to the drawings, and in particularly to FIG. 1, the ladder with an assist wheel that forms the basis of the present invention is designated generally by the reference number 10.

Figure 3:
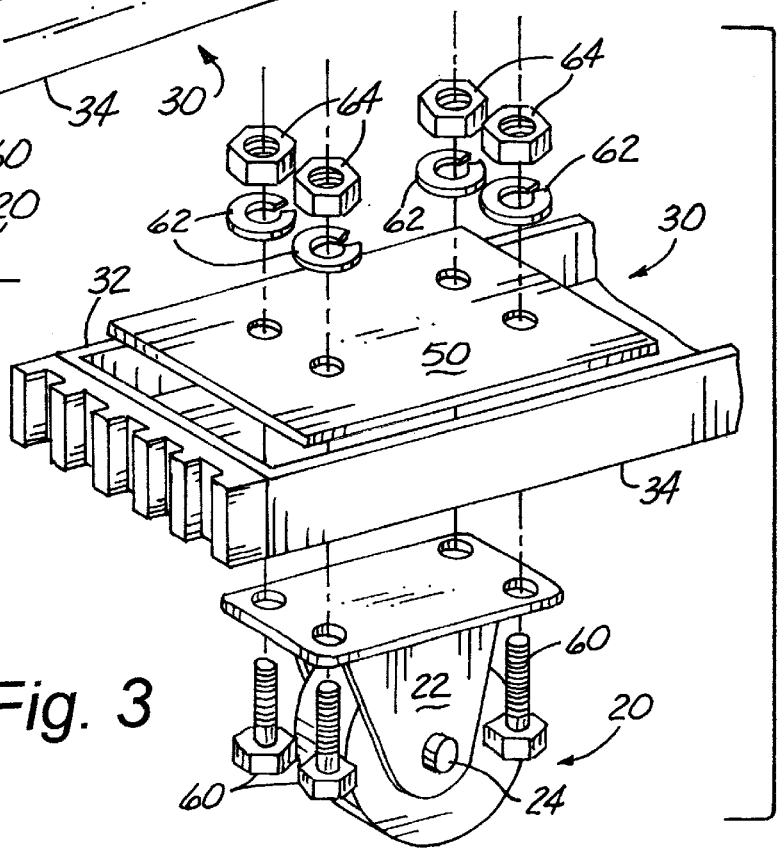
FIG. 3 is a greatly enlarged partial exploded perspective view showing the wheel attached to the outer face of the bottom of the side rail with a reinforcing plate in contact with the inner face of the side rail.

FIG. 1 shows a pair of ground wheels 20 attached at the lower end of one side of a dual access stepladder. The ladder includes side rails 30 with inner faces 32 and outer faces 34 interconnected by a number of rungs 40. As best seen in FIG. 3, each of the wheels 20 is attached to the outer face 34 and a reinforcing plate 50 is attached to the inner face 32 by bolts 60, lock washers 62, and nuts 64.

The wheel 20 is rotatably mounted on a bracket 22 by a shaft 24 whose axis is disposed parallel to the plane defined by the outer surface 34 of the side rail 30. The wheels 20 extend out from the outer surface 34 so that they do not interfere with the safety or stability of the ladder while it is in use. The assist wheels 20 may be used on a variety of ladder types including the dual access stepladder illustrated in FIG. 1. To use the assist wheels 20, the ladder is simply folded and transported on its side from place to place on the job site. This leaves one hand of the workers free to carry a toolbox or other items.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A ladder assist wheel assembly comprising:

a ladder having a first pair of spaced elongated side rails, each having a top end, a bottom end, an inner face, and an outer face, the outer face defining a plane;

a plurality of rungs attached to and interconnecting the inner faces of the first pair of side rails; and, a ground wheel attached to and disposed to extend perpendicularly from the outer face of one of the side rails a substantial portion of the ground wheel being rotatably mounted about an axis that is disposed parallel to the plane of the outer face; and perpendicular to the longitudinal axis of said one of the side rails; wherein, the outer face is opposed to a horizontal surface when the exterior of the ground wheel is in contact with said horizontal surface.

2. The ladder assist wheel assembly of claim 1 wherein the ground wheel is selectively attached adjacent one of the bottom ends of the said one of the side rails.

3. The ladder assist wheel assembly of claim 2 wherein the ground wheel is attached adjacent the bottom end of the said one of the side rails.

4. The ladder assist wheel assembly of claim 3 further including a reinforcing plate disposed to engage the inner face of the said one of the side rails, the reinforcing plate being operably attached to the ground wheel.

5. The ladder assist wheel assembly of claim 2 further including a reinforcing plate disposed to engage the inner face of the said one of the side rails, the reinforcing plate being operably attached to the ground wheel.

6. The ladder assist wheel assembly of claim 1 further including a reinforcing plate disposed to engage the inner face of the one of the said one of the side rails, the reinforcing plate being operably attached to the ground wheel.

7. A ladder assist wheel assembly for a dual access ladder, comprising:

a first ladder section including a first pair of spaced elongated side rails, each having a top end, a bottom end, an inner face, and an outer face, the outer face defining a first plane, and a plurality of rungs attached to and interconnecting the inner faces of the first pair of rails;

a second ladder section including a second pair of spaced elongated side rails, each having a top end, a bottom end, an inner face, and an outer face, the outer face defining a second plane, and a plurality of rungs attached to an interconnecting the inner faces of the second pair of rails, the second ladder being pivotally attached to the first ladder at the respective top ends of the first and second pairs of side rails;

a first ground wheel attached to and disposed to extend perpendicularly from the outer face of one of the first pair of side rails, a substantial portion of the first ground wheel being rotatably mounted about a first axis that is disposed parallel to the plane of the outer face of said one of the first pair of side rails; and, perpendicular to a longitudinal axis of said one of the first pair of side rails;

a second ground wheel attached to and disposed to extend perpendicularly from the outer face of one of the second pair of side rails, a substantial portion of the second ground wheel being rotatably mounted about a second axis that is disposed parallel to the plane of the outer face of said one of the second pair of side rails; and perpendicular to the longitudinal axis of said one of the second pair of side rails; wherein, said outer faces are opposed to a horizontal surface hen the exterior of the first and second ground wheels are in contact with said horizontal surface.

8. The ladder assist assembly of claim 7 wherein the first and second ground wheels are selectively attached adjacent one of the top and bottom ends of the respective first and second pairs of side rails.

9. The ladder assist wheel assembly of claim 8 wherein the first and second wheels are attached adjacent the bottom ends of the respective first and second pairs of side rails.

10. The ladder assist wheel assembly of claim 8 further including first and second reinforcing plates disposed to engage the inner faces of the respective one of the first and second side rails, the first and second reinforcing plates being operably attached to the respective first and second ground wheels.

11. The ladder assist wheel assembly of claim 8 further including first and second reinforcing plates disposed to engage the inner faces of the respective one of the first and second side rails, the first and second reinforcing plates being operably attached to the respective first and second ground wheels.

12. The ladder assist wheel assembly of claim 7 further including first and second reinforcing plates disposed to engage the inner faces of the respective one of the first and second side rails, the first and second reinforcing plates being operably attached to the respective first and second ground wheels.

* * * * *